US008095036B2

(12) United States Patent
Yoshino et al.

(10) Patent No.: US 8,095,036 B2
(45) Date of Patent: Jan. 10, 2012

(54) PROCESS CARTRIDGE

(75) Inventors: Yasufumi Yoshino, Fukuoka (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 12/471,926

(22) Filed: May 26, 2009

(65) Prior Publication Data

US 2009/0297219 A1 Dec. 3, 2009

(30) Foreign Application Priority Data

May 27, 2008 (JP) ..... 2008-138247

(51) Int. Cl.
*G03G 21/18* (2006.01)

(52) U.S. Cl. ..... 399/114

(58) Field of Classification Search ..... 399/111–114
See application file for complete search history.

(56) References Cited

U.S. PATENT DOCUMENTS

| | | | | |
|---|---|---|---|---|
| 6,782,219 | B2 | 8/2004 | Yoshino et al. | 399/90 |
| 6,915,092 | B2 | 7/2005 | Yamaguchi et al. | 399/109 |
| 6,947,686 | B2 * | 9/2005 | Kawai et al. | 399/111 |
| 6,978,100 | B2 | 12/2005 | Yasui et al. | 399/103 |
| 6,980,759 | B2 * | 12/2005 | Kanno et al. | 399/111 |
| 6,983,115 | B2 | 1/2006 | Isobe et al. | 399/119 |
| 7,068,965 | B2 | 6/2006 | Yoshino et al. | 399/119 |
| 7,099,607 | B2 | 8/2006 | Suzuki et al. | 399/111 |
| 7,155,137 | B2 | 12/2006 | Yasui et al. | 399/103 |
| 7,366,439 | B2 | 4/2008 | Anan et al. | 399/109 |
| 7,929,881 | B2 * | 4/2011 | Yoshino et al. | 399/113 |
| 2007/0092291 | A1 | 4/2007 | Suzuki et al. | 399/111 |
| 2007/0206971 | A1 | 9/2007 | Yoshino | 399/111 |
| 2008/0138105 | A1 | 6/2008 | Kanno et al. | 399/111 |
| 2008/0138106 | A1 | 6/2008 | Kanno et al. | 399/111 |
| 2008/0138109 | A1 | 6/2008 | Anan et al. | 399/113 |
| 2008/0138110 | A1 | 6/2008 | Yoshino et al. | 399/114 |

FOREIGN PATENT DOCUMENTS

| | | |
|---|---|---|
| JP | 2002-6722 | 1/2002 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A member for performing separation holding of a developing roller of a process cartridge is provided at a position opposite from a photosensitive drum with respect to a swing center. A detachably mountable protective cover is mounted to the process cartridge and a projection of the protective cover is inserted between the photosensitive drum and a developing device frame which supports the developing roller. The projection of the protective cover is inserted in a non-contact state with the photosensitive drum and the developing device frame.

5 Claims, 16 Drawing Sheets

PROCESS CARTRIDGE

FIELD OF THE INVENTION AND RELATED ART

The present invention relates to a process cartridge detachably mountable to an electrophotographic image forming apparatus.

Here, an electrophotographic image forming apparatus refers to an apparatus which forms an image on recording material (medium) with the use of electrophotographic image forming method. As the example of an electrophotographic image forming apparatus, an electrophotographic copying machine, an electrophotographic printer (for example, laser beam printer, LED printer, etc.), a facsimile machine, a word processor, etc., may be included.

Further, the process cartridge refers to a cartridge in which at least a developing means and an electrophotographic photosensitive member are integrally supported, and which is detachably mountable to the main assembly of an electrophotographic image forming apparatus.

In the field of an electrophotographic image forming apparatus which uses an electrophotographic image forming process, it has been a common practice to employ a process cartridge system, in which the electrophotographic photosensitive member and one or more processing means for processing the electrophotographic photosensitive drum member are integrally supported in a cartridge which is detachably mountable to the main assembly of the electrophotographic image forming apparatus. According to this process cartridge system, it is possible for a user to perform maintenance of the apparatus by himself (herself) without relying on a service person, so that operativity can be significantly improved. Therefore, the process cartridge system is widely in use in the field of the electrophotographic image forming apparatus.

In the electrophotographic image forming apparatus, the electrophotographic photosensitive member is irradiated with light emitted from a laser, an LED, a lamp, or the like, corresponding to image information. As a result, an electrostatic latent image is formed on the electrophotographic photosensitive member. The electrostatic latent image is developed by a developing device. Then, the developed (electrostatic latent) image on the electrophotographic photosensitive member is transferred onto the recording material. As a result, an image is formed on the recording material.

In the above-described process, the process cartridge is required, during mounting thereof to the electrophotographic image forming apparatus main assembly, that a portion of the electrophotographic photosensitive member to be opposed to the recording material and a portion of the electrophotographic photosensitive member to be opposed to the main assembly-side process means acting on the electrophotographic photosensitive member are exposed.

Therefore, in order not to damage the surface of the electrophotographic photosensitive member before the use of the process cartridge and during transportation of the process cartridge, a protective cover detachably mountable to the process cartridge is provided to the process cartridge. Then, during the use of the process cartridge, the process cartridge is mounted to the electrophotographic image forming apparatus main assembly in a state in which the protective cover is removed.

Further, in order to prevent deformation of a developing roller due to long term contact between the electrophotographic photosensitive member and the developing roller during non-use of the process cartridge and prevent density non-uniformity or the like due to the deformation, such a method that a spacer provided to the protective cover is inserted into a gap between the electrophotographic photosensitive member and the developing roller to maintain a resultant separation state has been known (Japanese Laid-Open Patent Application 2002-006722). Further, in another conventional method, the separation of the developing roller from the electrophotographic photosensitive member is performed by insertion of a spacer provided to a protective cover for the electrophotographic photosensitive member. Then, during the use of the process cartridge, in order to easily remove the protective cover, a photosensitive member unit and a developing unit are moved apart from each other to remove the protective cover.

SUMMARY OF THE INVENTION

A principal object of the present invention is to provide a process cartridge capable of easily perform mounting and demounting of a protective cover while preventing contact between an electrophotographic photosensitive member and a developing roller due to long term storage of an unused process cartridge, impact during transportation, or the like.

According to an aspect of the present invention, there is provided a process cartridge comprising:

a first unit including an electrophotographic photosensitive member;

a second unit including a developing roller contactable to the electrophotographic photosensitive member for developing an electrostatic latent image formed on the electrophotographic photosensitive member, the second unit being swingable about a swing shaft with respect to the first unit;

an urging member for exerting an urging force between the first unit and the second unit so as to contact the developing roller to the electrophotographic photosensitive member;

a developing device space keeping member for keeping a space between the developing roller and the electrophotographic photosensitive member; and a protective cover, detachably mountable to at least one of the first unit and the second unit, including a protective portion for protecting the electrophotographic photosensitive member and including a projection which is insertable into a gap between the first unit and the second unit so as to prevent contact between the electrophotographic photosensitive member and the developing roller and which is non-contactable to the first unit and the second unit in a developing device space keeping state by the developing device space keeping member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

Hereinafter, the process cartridge (hereinafter referred to simply as cartridge) and electrophotographic color image forming apparatus (hereinafter referred to simply as image forming apparatus), in First Embodiment of the present invention will be described with reference to the drawings.

(General Structure of Image Forming Apparatus)

Figure 2:
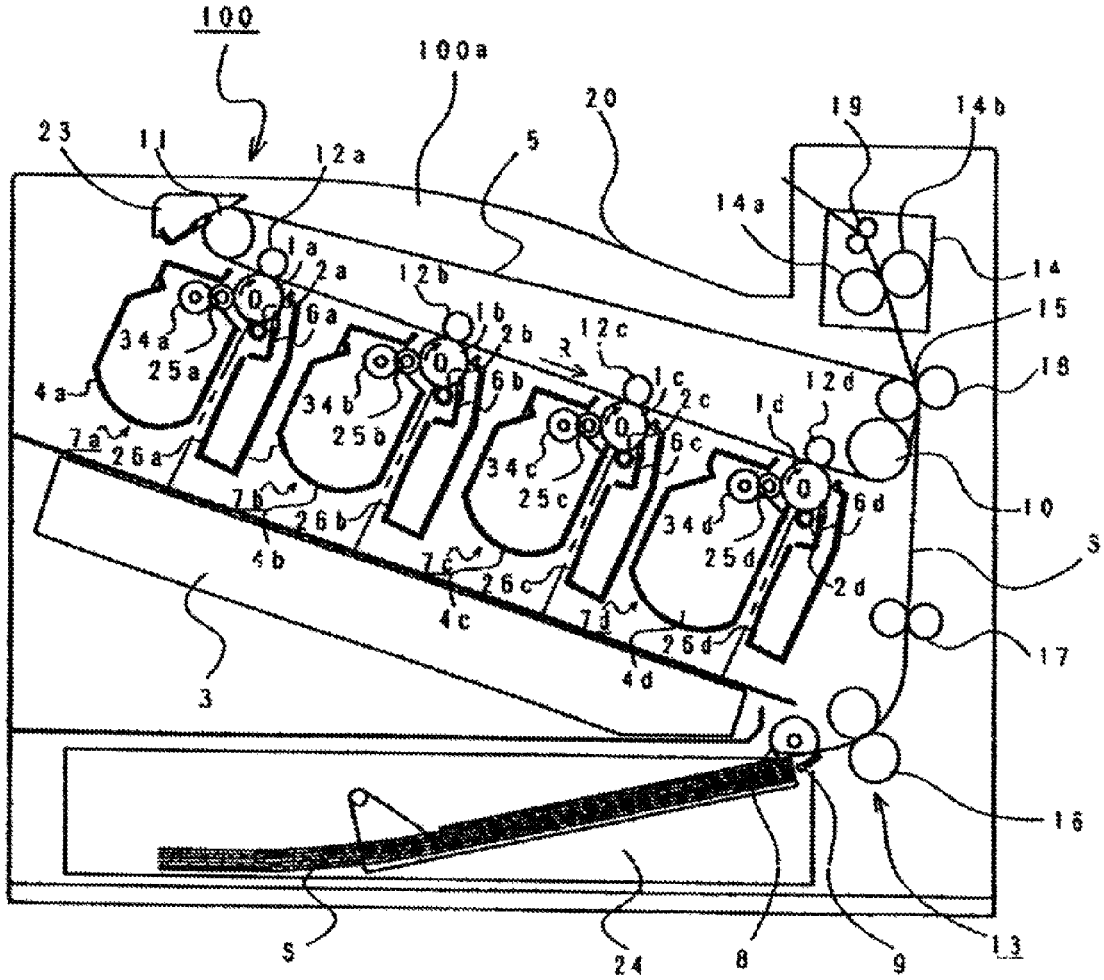
FIG. 2 is a schematic view showing a general arrangement of a color electrophotographic image forming apparatus in embodiments of the present invention.

First, referring to FIG. 2, the general structure of the image forming apparatus will be described. The image forming apparatus 100 shown in FIG. 2 has four mounting portions 22 (22*a*-22*d*) (FIG. 3) as mounting means for four cartridge, which are juxtaposed in tandem, in a straight line which is slanted relative to the horizontal direction. The cartridge 7 (7*a*-7*d*), which are mounted into the mounting portions 22, are provided with electrophotographic photosensitive drums 1 (1*a*, 1*b*, 1*c* and 1*d*), respectively.

The abovementioned electrophotographic photosensitive drum (hereinafter referred to as photosensitive drum) 1 is rotationally driven in the clockwise direction indicated by an arrow in the figure by a driving member (unshown). Around the photosensitive drum 1, the following process means acting on the photosensitive drum 1 are disposed along its rotational direction in the order of a cleaning member 6 (6*a*, 6*b*, 6*c*, or 6*d*) for removing developer remaining on the photosensitive drum 1 surface after transfer (hereinafter referred to as toner); a charge roller 2 (2*a*, 2*b*, 2*c*, or 2*d*) for uniformly charging the surface of the photosensitive drum 1; a developing unit 4 (4*a*, 4*b*, 4*c*, or 4*d*) for developing an electrostatic latent image with the toner; a scanner unit 3 for forming the electrostatic latent image on the surface of the photosensitive drum 1 by irradiation with a laser beam on the basis of image information; and an intermediary transfer belt 5 onto which four toner images formed on the photosensitive drums 1 are collectively transferred. The photosensitive drum 1, the cleaning member 6, the charge roller 2, and the developing unit 4 are integrally supported to constitute a cartridge 7. The cartridge 7 is detachably mountable to a main assembly 100*a* of the image forming apparatus 100 by a user.

The intermediary transfer belt 5 is stretched around a driving roller 10 and a tension roller 11. Inside the intermediary transfer belt 5, four primary transfer rollers 12 (12*a*-12*d*) are disposed oppositely to the photosensitive drums 1 (1*a*-1*d*). To the intermediary transfer belt 5, a transfer bias is applied by a bias applying means (unshown).

A toner image formed on each of the surface of the photosensitive drum 1 is successively primary-transferred onto the intermediary transfer belt 5 by rotation of the photosensitive drum 1 in the direction indicated by an arrow Q, rotation of the intermediary transfer belt 5 in the direction indicated by an arrow R, and by application of a positive bias to the primary transfer roller 12. Then, the four toner images in a superposed state on the intermediary transfer belt 5 are conveyed to the secondary transfer portion 15.

In synchronism with the above-mentioned image forming operation, a sheet S as the recording material is conveyed by a conveying means consisting of a sheet feeding device 13, a pair of registration rollers 17, etc. The sheet feeding device 13 has a sheet feeding cassette 24 for accommodating the sheet S, a sheet feeding roller 8 for feeding the sheet S, and a pair of sheet conveying rollers 16 for conveying the fed sheet S. The sheet feeder cassette 24 can be pulled out of the apparatus main assembly 100*a* in the frontward direction in FIG. 2. The sheet S is pressed against the sheet feeding roller 8 and is separated one by one by a separation pad 9 (one-side friction sheet separating method), thus being conveyed.

The sheet S conveyed from the sheet feeding device 13 is conveyed to the secondary transfer portion 15 by the pair of registration rollers 17. At the secondary transfer portion 15, the positive bias is applied to the secondary transfer roller 18. As a result, the four toner images on the intermediary transfer belt 5 are secondary-transferred onto the conveyed sheet S.

A fixing portion 14 as a fixing means fixes the toner images on the conveyed sheet S by applying heat and pressure to the toner images formed on the sheet S. A fixing belt 14*a* is cylindrical and is guided by a belt guiding member (unshown) to which a heat generating means, such as a heater is bonded. The fixing belt 14*a* and the pressing roller 14*b*, form a fixing nip with a predetermined press-contact force.

The sheet S on which the unfixed toner images conveyed from the image forming portions is heated and pressed in the fixing nip. As a result, the unfixed toner images on the sheet S is fixed on the sheet S. Thereafter, the sheet S on which the toner images are fixed is discharged on a sheet discharge tray 20 by a pair of sheet discharge rollers 19.

The toner remaining on the surface of the photosensitive drum 1 after the toner image transfer is removed by the cleaning member 6. The removed toner is collected in a removed toner chamber in the photosensitive member unit 26 (26*a*-26*d* ).

The toner remaining on the intermediary transfer belt 5 after the second transfer onto the sheet S is removed by a transfer belt cleaning device 23. The removed toner is conveyed through a waste toner conveyance passage (unshown), and is collected in a waste toner collecting container (unshown) located in the rear end portion of the apparatus.

(Cartridge)

Figure 3:
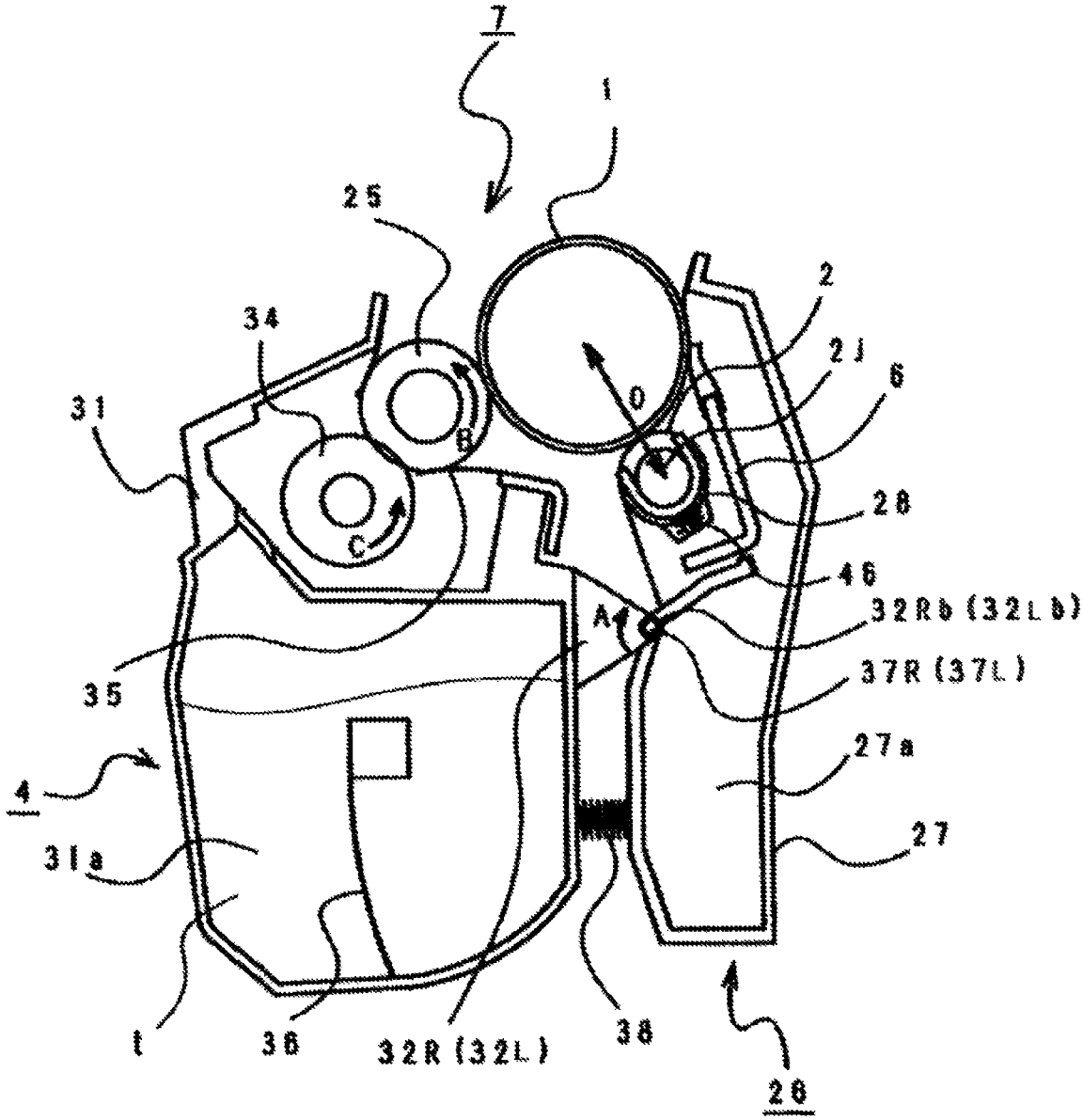
FIG. 3 is a schematic sectional view for illustrating the process cartridge.

Next, referring to FIG. 3, the cartridge in this embodiment will be described. FIG. 3 is a principal sectional view of the cartridge 7 containing toner t. Incidentally, the cartridges 7*a*, 7*b*, 7*c*, and 7*d*, which contain yellow, magenta, cyan, and black toners t, respectively, are the same in structure.

Each cartridge 7 is separated into a photosensitive member unit 26 as a first unit and a developing unit 4 as a second unit. The photosensitive member unit 26 includes the photosensitive drum 1, charge roller 2 (charging means), and cleaning member 6 (cleaning means). The developing unit 4 includes a developing roller 25 (developing means). The photosensitive drum 1 is rotatably supported by a cleaning device frame 27 of the photosensitive member unit 26 through a pair of bearings described later. The photosensitive drum 1 is rotationally driven correspondingly to the image forming operation by transmitting the driving force from a motor (unshown) to the photosensitive member unit 26.

The charge roller 2 and the cleaning member 6 are disposed on the peripheral surface of the photosensitive drum 1 as described previously. The residual toner removed from the surface of the photosensitive drum 1 by the cleaning member 6 falls into the removed toner chamber 27*a*. The cleaning device frame 27 is fitted with a pair of charging roller bearings 28, which are movable in the direction indicated by an arrow D, which passes through the centers of the charging roller 2 and the photosensitive drum 1. A shaft 2*j* of the charge roller 2 is rotatably supported by the pair of charging roller bearings 28. Further, the bearings 28 are kept pressed toward the photosensitive drum 1 by a charge roller pressing member 49.

The developing unit 4 has the developing roller 25 rotating in contact with the photosensitive drum 1 in the direction indicated by an arrow B, and has a developing device frame 31. The developing roller 25 is rotatably supported by the developing device frame 31 through shaft supporting member 32 (32R, 32L) attached to both longitudinal sides of the developing device frame 31. On the peripheral surface of the developing roller 25, a toner supplying roller 34 rotatable in contact with the developing roller 25 in the direction indicated by an arrow C, and a developing blade 35 for regulating in thickness the toner layer on the developing roller 25. Further, to a toner containing portion 31*a* of the developing device frame 31, a toner conveying member 36 conveying the contained toner to the toner supplying roller 34 while stirring the toner is provided. The developing unit 4 is rotatably connected to the photosensitive member unit 26 about shafts 37 (37R and 37L) engageable with holes 32Rb and 32Lb provided in the shaft supporting members 32Rb and 32Lb. The developing unit 4 is urged by urging spring 38. Thus, during the image formation, the developing unit 4 rotates about the shafts 37 in the direction indicated by an arrow A, so that the developing roller 25 is in contact with the photosensitive drum 1.

Next, a space keeping state of the developing device unit and a mounted state of the protective cover which are characterizing portions of the present invention will be described with reference to FIGS. 1 and 4 to 12.

Figure 1:
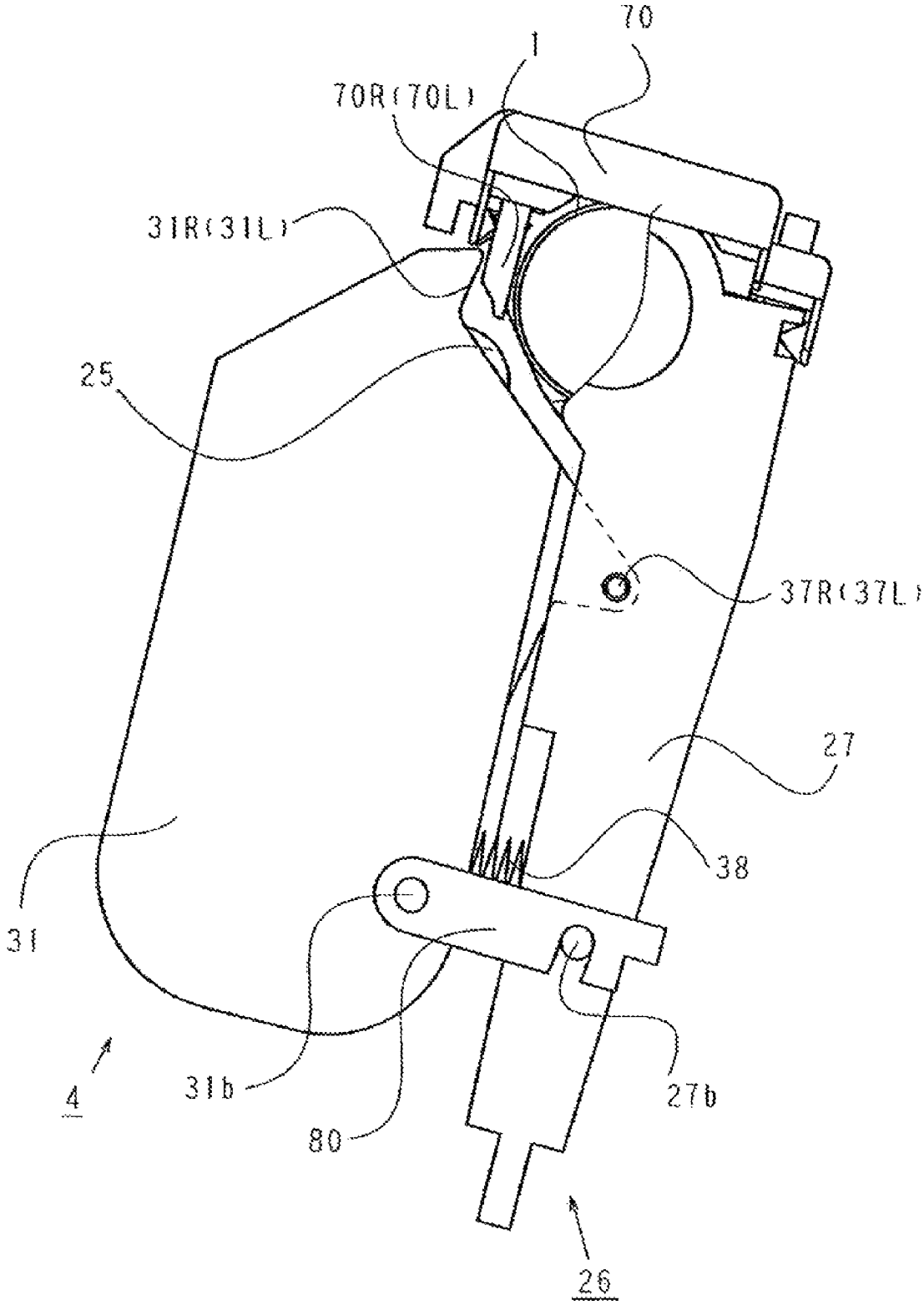
FIG. 1 is a schematic view showing a characterizing portion of a process cartridge in First Embodiment.

FIG. 1 is a schematic view showing a state in which the developing roller 25 is separated from the photosensitive drum 1.

As described above, the developing device unit 4 is rotatably supported by the cleaning device frame 27 of the photosensitive member unit 26 about the shafts 37 (37R, 37L). Further, between the cleaning device frame 27 and the developing device frame 31, the urging member 38 for urging the developing device frame 31 is provided in order to contact the developing roller 25 to the photosensitive drum 1.

Figure 7:
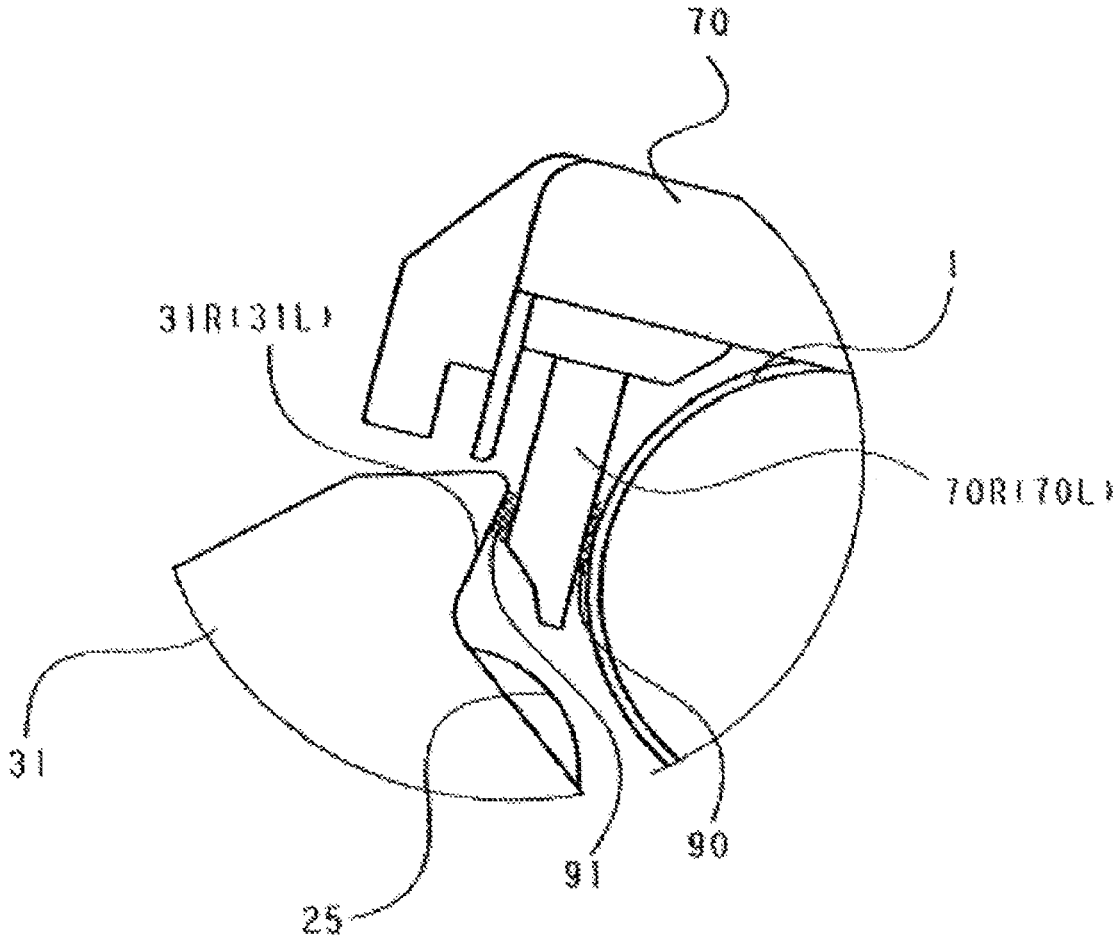
FIG. 7 is a detailed sectional view showing an inserted state of a projection of the protective cover.

Further, to the developing device frame 31, a developing device space keeping member 80 is provided rotatably about a rotation center shaft 31*b* on a side opposite from the photosensitive drum 1 with respect to the shafts 37 and in the neighborhood of the urging member 38. During non-use of the cartridge 7, as shown in FIG. 7, the developing device space keeping member 80 is hooked on a developing device space keeping member hooking portion 27*b*, so that a space is kept in a state in which the developing member 25 is separated from the photosensitive drum 1.

Further, as shown in FIG. 1, the protective cover 70 is provided so as to protect the photosensitive drum 1 during the non-use of the cartridge 7 and is detachable during the use of the cartridge 7.

Figure 4:
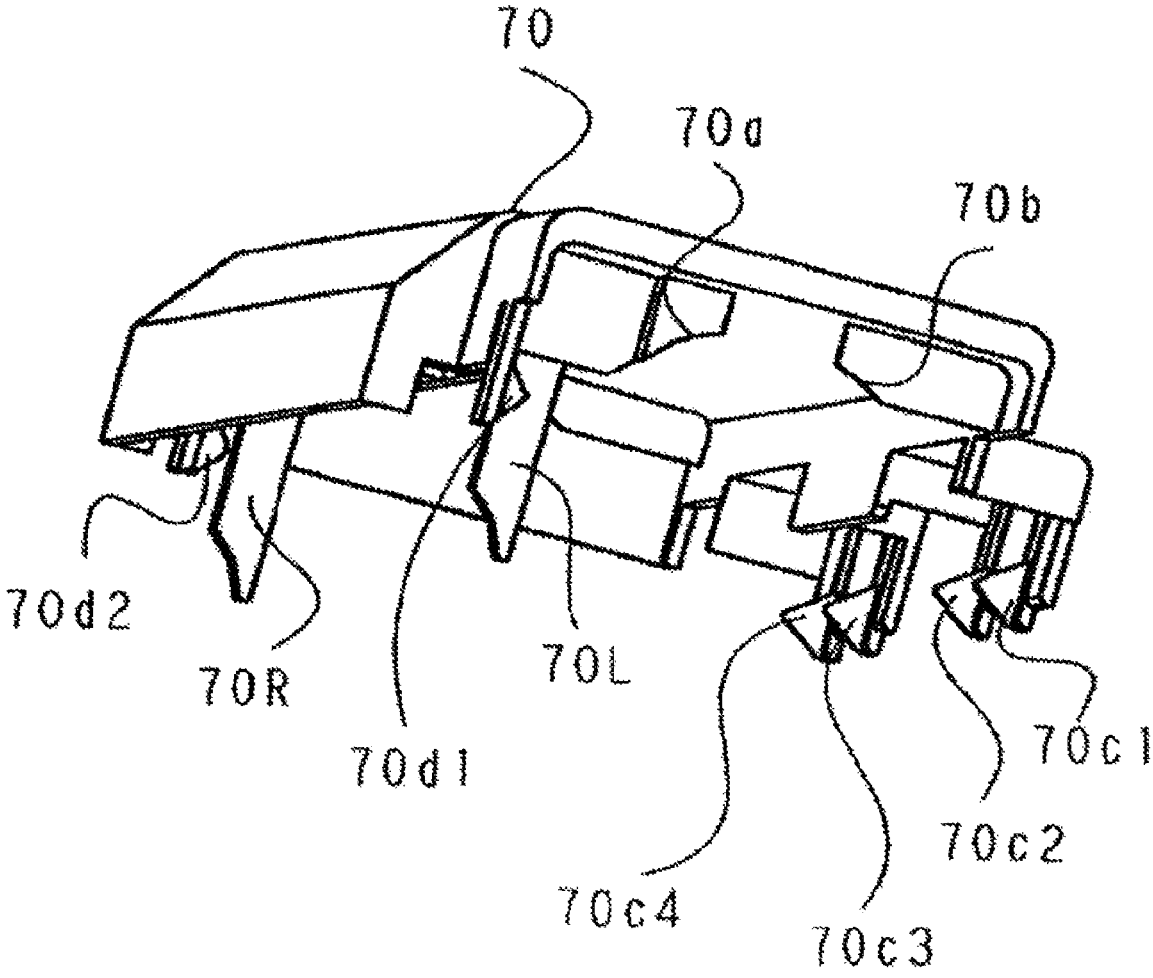
FIG. 4 is a perspective view of a protective cover.

The protective cover 70 is, as shown in FIG. 4, provided with hooking claw portions 70*c*1 to 70*c*4, 70*d*1, and 70*d*2, projections 70R and 70L, bearing abutment portions 70*a* and 70*b*, and a protective portion 70*e* for protecting the surface of the photosensitive drum 1.

Figure 5:
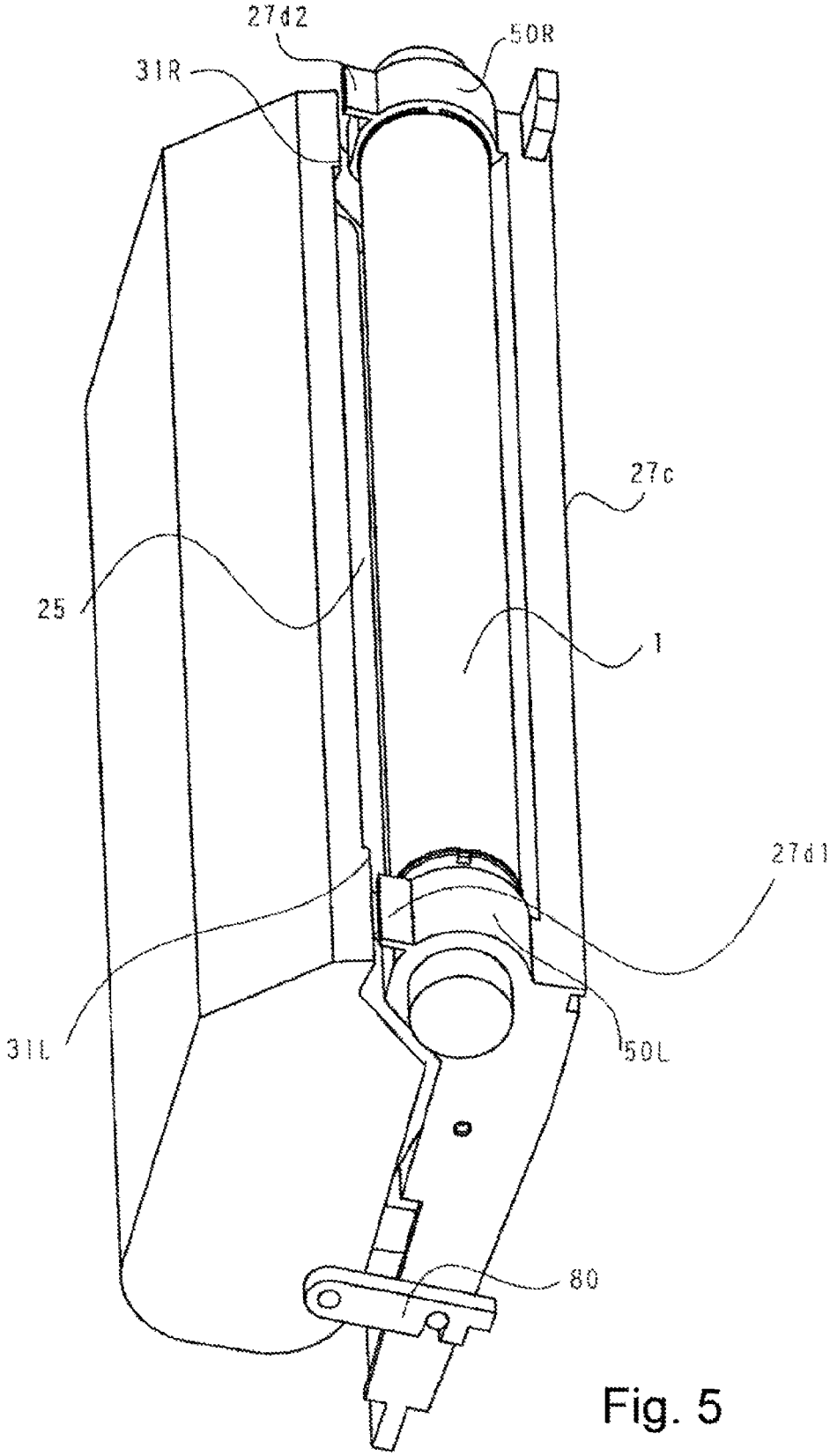
FIG. 5 is a perspective view of the process cartridge.

On the other hand, to the cartridge 7, as shown in FIG. 5, frame claw hooking portions 27*c*, 27*d*1, and 27*d*2, abutment portions 31R and 31L, and bearing portions 50R and 50L are provided.

Figure 6:
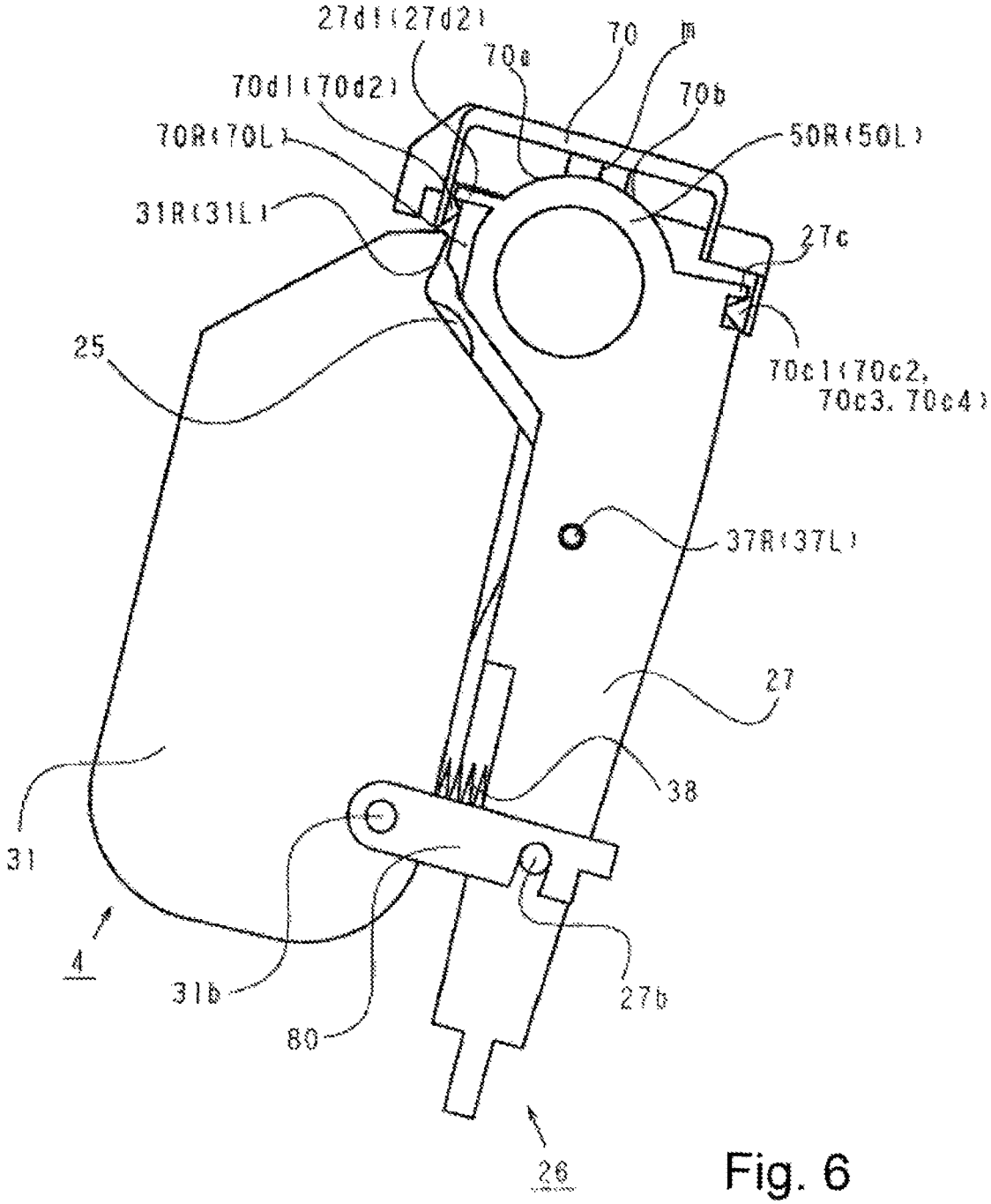
FIG. 6 is a schematic sectional view for illustrating mounting of the protective cover to the process cartridge.

The mounted state of the protective cover 70 is shown in FIG. 6. First, a distance m between the photosensitive drum 1 and the protective cover 70 is kept by abutment of the bearing abutment portions 70*a* and 70*b* of the protective cover 70 against the drum bearing portion 50R (50L) provided to the cleaning device frame 27. Therefore, the contact of the protective cover 70 with the photosensitive drum 1 is prevented.

Further, the hooking claw portions 70*c*1 to 70*c*4 and the hooking claw portions 70*d* of the protective cover 70 are fixed by being hooked on the frame hooking portion 27*c* and the hooking portions 27*d*1 and 27*d*2 of the cleaning device frame 27, respectively.

As shown in FIGS. 1 and 7, the projection 70R (70L) of the protective cover 70 is inserted between the photosensitive drum 1 and the abutment portion 31R (31L) provided to the longitudinal end portion of the developing device frame 31.

The projection 70R (70L) does not contact the photosensitive drum 1 and the abutment portion 31R (31L) of the developing device frame 31 and is inserted with a gap 90 and a gap 91. In this embodiment, each of the gaps 90 and 91 is about 1 mm.

During the user of the cartridge 71, the protective cover 70 is removed to be mounted to the apparatus main assembly 100*a*.

Figure 8:
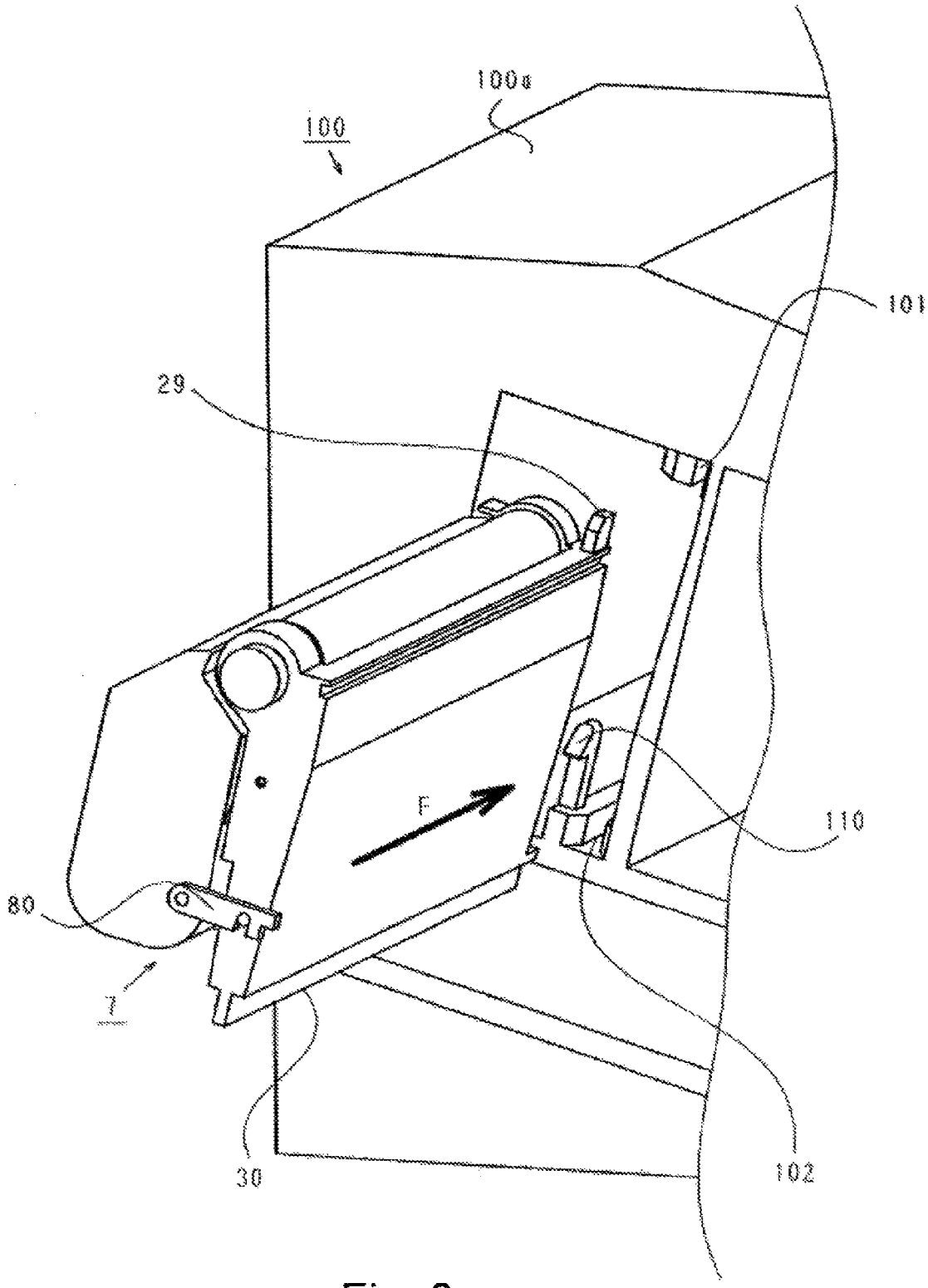
FIG. 8 is a perspective view showing an insertion state of the process cartridge into the image forming apparatus.

Next, the insertion state of the cartridge 7 into the apparatus main assembly 100*a* is shown in FIG. 8.

In FIG. 8, the cartridge 7 is inserted in the direction indicated by an arrow F to be mounted in the apparatus main assembly 100*a* by fitting an upper guide 29 and a lower guide 30 to an upper guide groove 101 and a lower guide groove 102, respectively, of the apparatus main assembly 101*a*.

The apparatus main assembly 100*a* is provided with a main assembly-side projection 110 for releasing the space keeping member 80.

Figure 10:
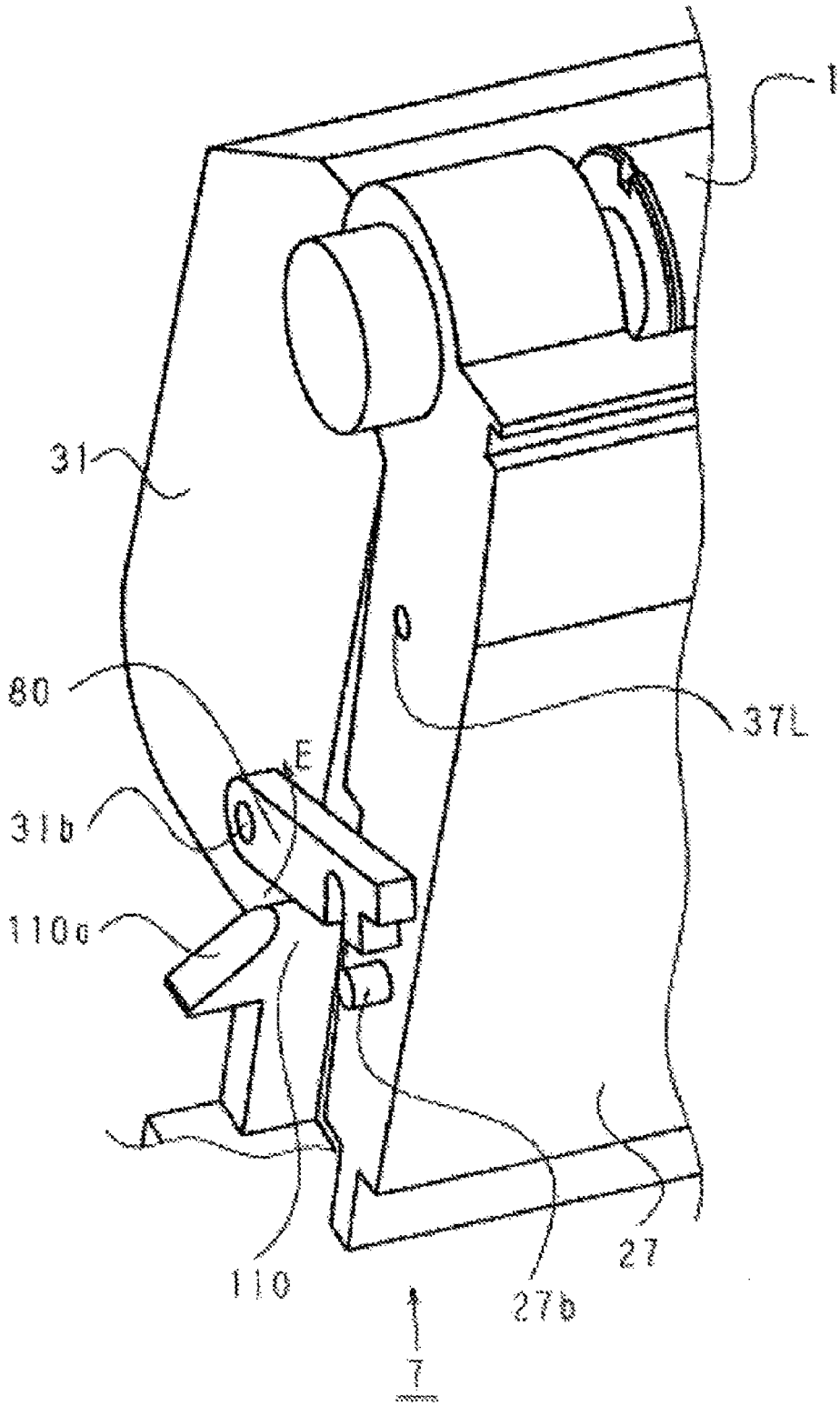
FIG. 10 is a schematic view showing a state of the process cartridge after the release of space keeping by the space keeping member.
Figure 11:
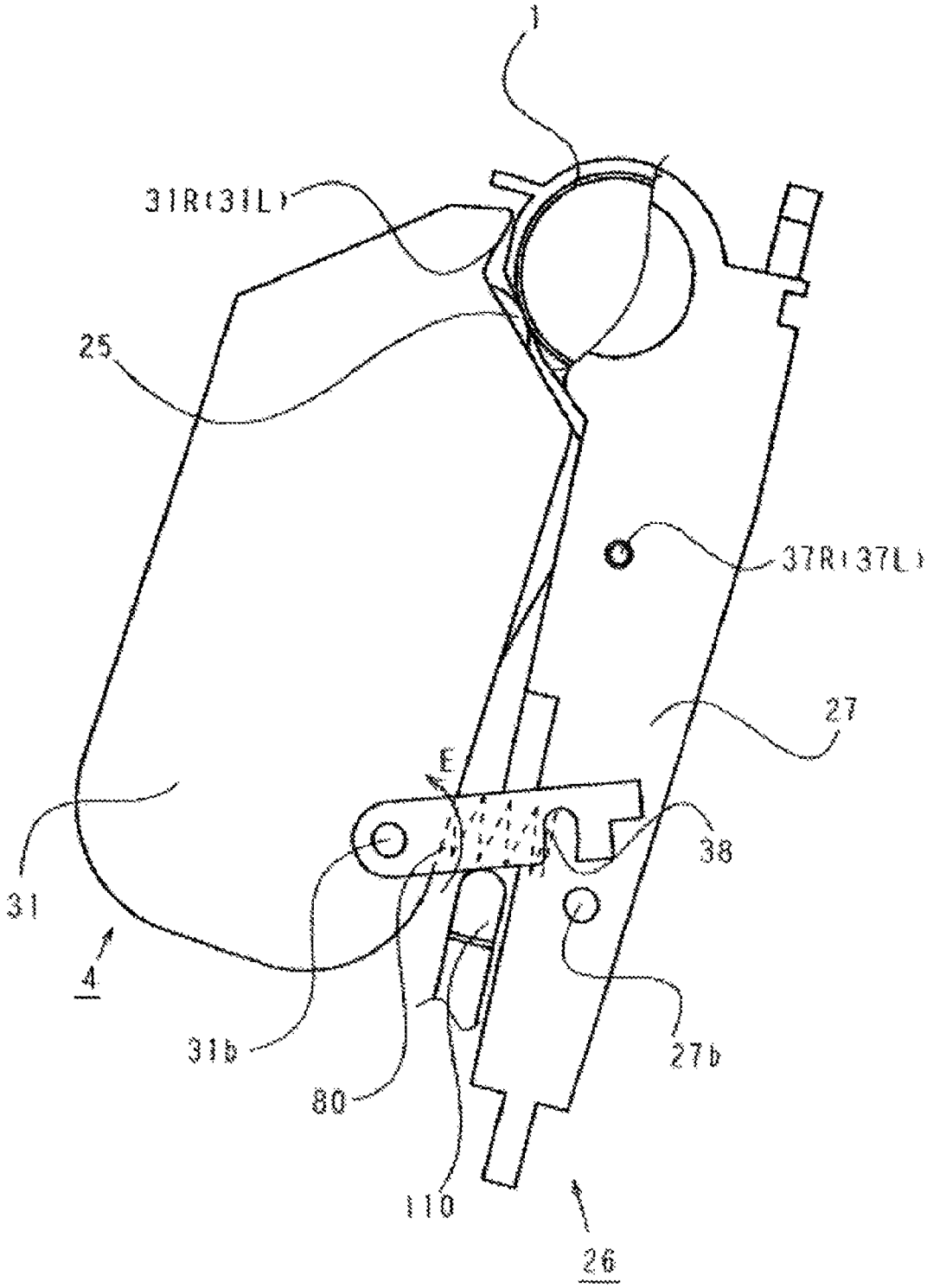
FIG. 11 is a schematic view showing a state of the release of space keeping by the space keeping member in the process cartridge.

Next, a releasing method of the space keeping member 80 by the insertion of the cartridge 7 will be described with reference to FIGS. 9 to 11.

Figure 9:
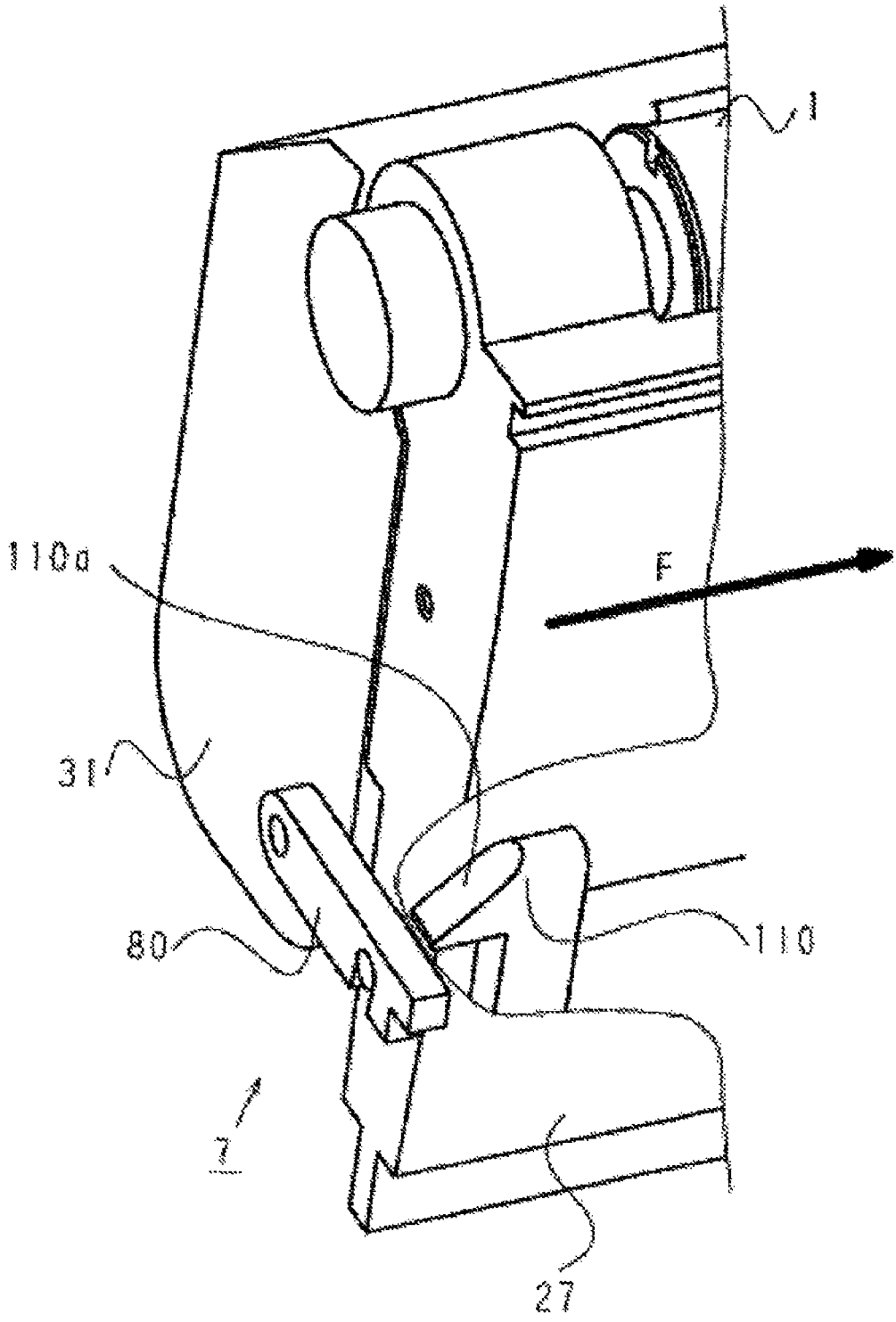
FIG. 9 is a schematic view showing a state of the process cartridge before released of space keeping by a space keeping member.

In FIG. 9, when the cartridge 7 is inserted into the apparatus main assembly 100*a*, the main assembly-side projection 110 awaits the cartridge 7 and is provided with an inclined portion 110*a*. When the cartridge 7 is mounted, as shown in FIG. 10, the space keeping member 80 is rotationally moved in the direction indicated by an arrow E about the rotation center shaft 31*b* by the inclined portion 110*a*, thus being released from the space keeping member hooking portion 27*b*. Thus, as shown in FIG. 11, the developing device frame 31 is swingable (rotatable) about swing shafts 37R and 37L as a swing center, so that the developing roller 25 is contactable to the photosensitive drum 1 by urging force of the urging member 38.

By the above-described constitution, the space keeping of the developing roller 25 is releasable by the mounting operation of the cartridge 7 and a subsequent series of operations.

Therefore, the operation by the user is not required except for the mounting operation of the cartridge 7, so that operativity of the user can be improved.

Incidentally, in this embodiment, the space keeping member 80 is provided to the developing device frame 31 but a similar effect can also be obtained even by being provided to the cleaning device frame 27 as the other frame.

By the constitution described above, during the non-use of the cartridge such as during shipment, the developing roller 23 can be kept in the separated state from the photosensitive drum 1 by the space keeping member 80.

Figure 12:
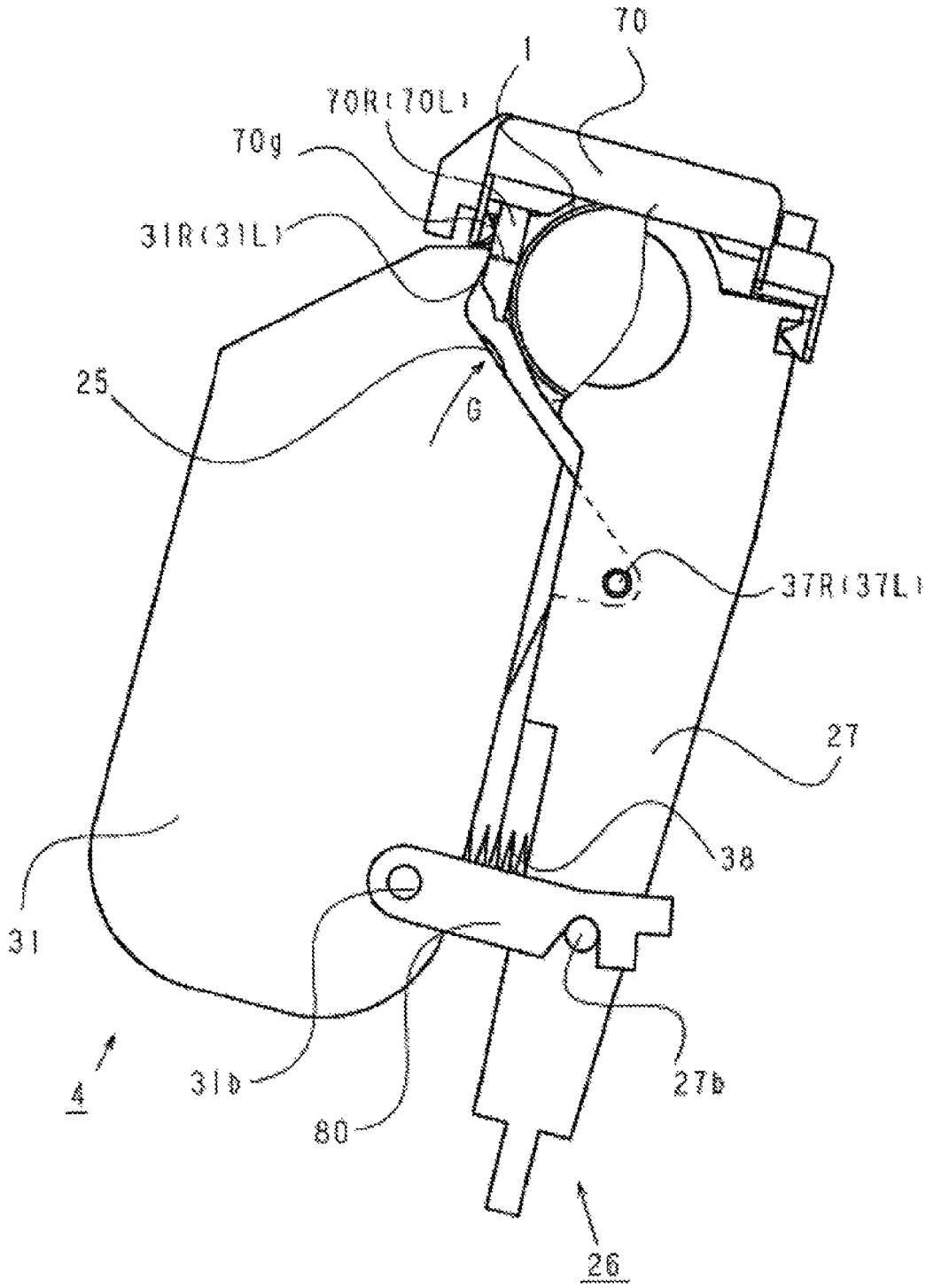
FIG. 12 is a schematic view showing a state of the process cartridge during transportation.

FIG. 12 is a schematic view showing the case where the space keeping member 80 is bent by being subjected to impact due to transportation during the shipment to move the developing member 25 toward the photosensitive drum 1 in a contact direction indicated by an arrow G. In this case, the abutment portions 31R and 31L of the developing device frame 31 abut against the projections 70R and 70L of the protective cover. The projections 70R and 70L of the protective cover 70 have a width 70*g* so that the abutment portions 31R and 31L of the developing device frame 31 abut against the projections 70R and 70L before the contact between the developing roller 25 and the photosensitive drum 1. In this embodiment, between the photosensitive drum 1 and the abutment portions 31R and 31L, a gap of about 1 mm is provided from the surfaces of the projections 70R and 70L on the abutment portion side. Further, even when the gap of about 1 mm is removed by the movement of the developing device frame 31, the developing roller 25 is configured so as not to contact the photosensitive drum 1.

Therefore, the spacing between the developing roller 25 and the photosensitive drum 1 can be kept, so that it is possible to prevent the contact between the developing roller 25 and the photosensitive drum 1. Thus, friction or the like due to the contact can be prevented, so that a stable image can be obtained.

Further, in the neighborhood of the urging member 38, the space keeping is made by the space keeping member 80 and at a position opposite to the shafts 37 as the rotation center, the projections 70R and 70L of the protective cover are inserted between the photosensitive drum 1 and the developing device frame 31. When the cartridge 7 is subjected to the impact due to the transportation or the like, the space keeping member 80 not only keeps the space but also regulates further movement of the projections 70R and 70L of the protective cover with respect to the movement of the developing roller 25 toward the photosensitive drum 1. Therefore, the transportation impact only applied to the space keeping member can also be distributed to the projections 70R and 70L of the protective cover 70. Accordingly, deformation of the space keeping member 80 can be suppressed, so that the space of the developing roller 25 can be stably kept.

Further, the projections 70R and 70L of the protective cover 70 are inserted between the photosensitive drum 1 and the abutment portions 31R and 31L of the developing device frame 31 with the gaps, so that a load is not increased when the user demounts the protective cover. Therefore, the operativity of the user can be improved.

After the use of the cartridge, the space keeping member 80 is kept in the demounted state, so that the developing member 25 is placed in the contact state. When the protective cover is mounted again, the projections are inserted between the photosensitive drum and the developing device frame, so that the space is kept during the removal of the process cartridge. Therefore, it is possible to prevent long-term contact of the developing member with the photosensitive drum 1, so that the state of the developing member can be satisfactorily maintained.

Second Embodiment

Next, Second Embodiment of the present invention will be described with reference to FIG. 13 to FIG. 16.

The same structural portions or members as those in First Embodiment are represented by identical reference numerals or symbols and a portion different from that in First Embodiment will be described.

Figure 13:
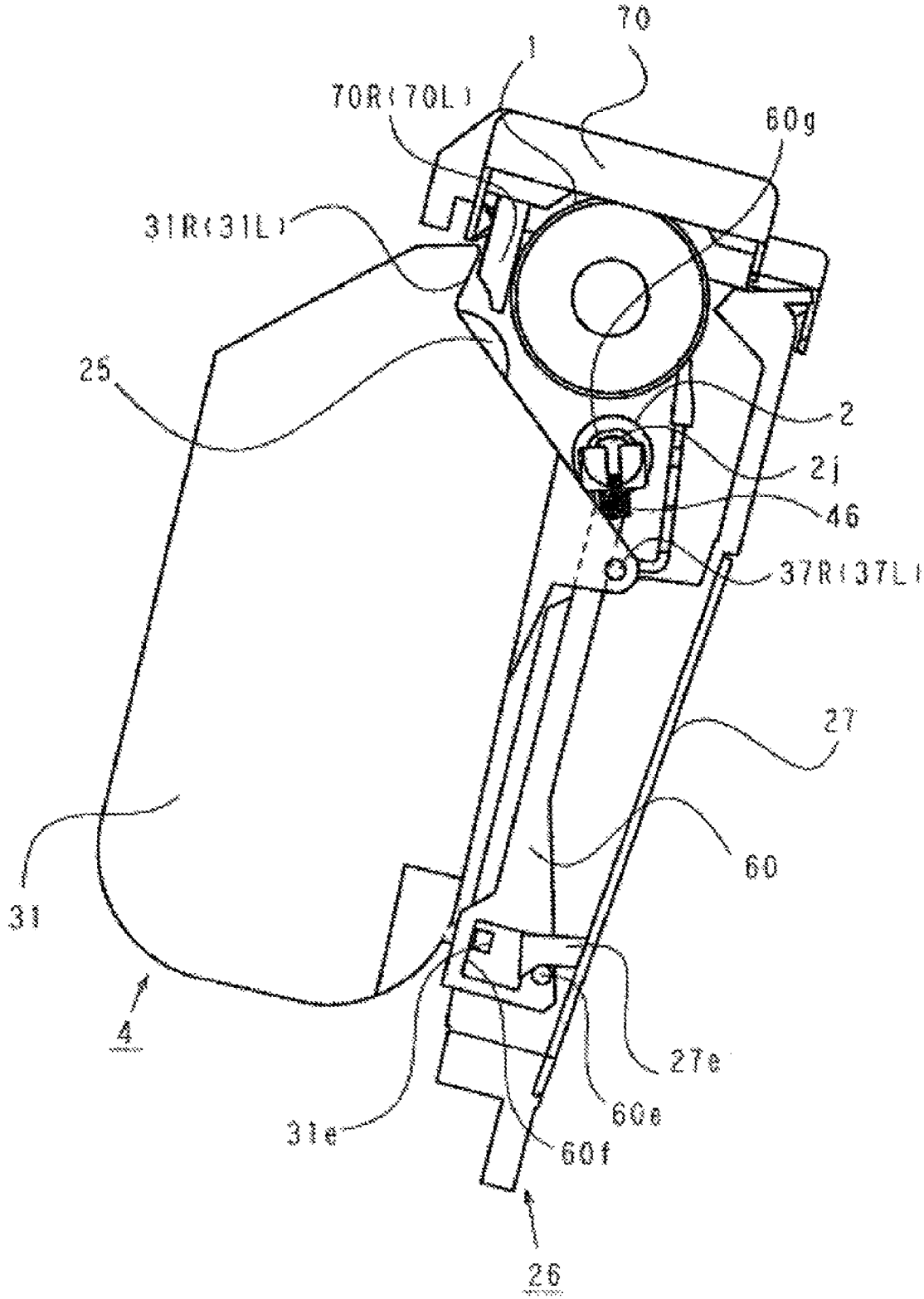
FIG. 13 is a detailed view of a charging device space keeping member in Second Embodiment.

In this embodiment, as shown in FIG. 13, the photosensitive member unit 26 includes a charging device space keeping member 60 for keeping a space of the charging roller 2 from the photosensitive drum 1.

Figure 14:
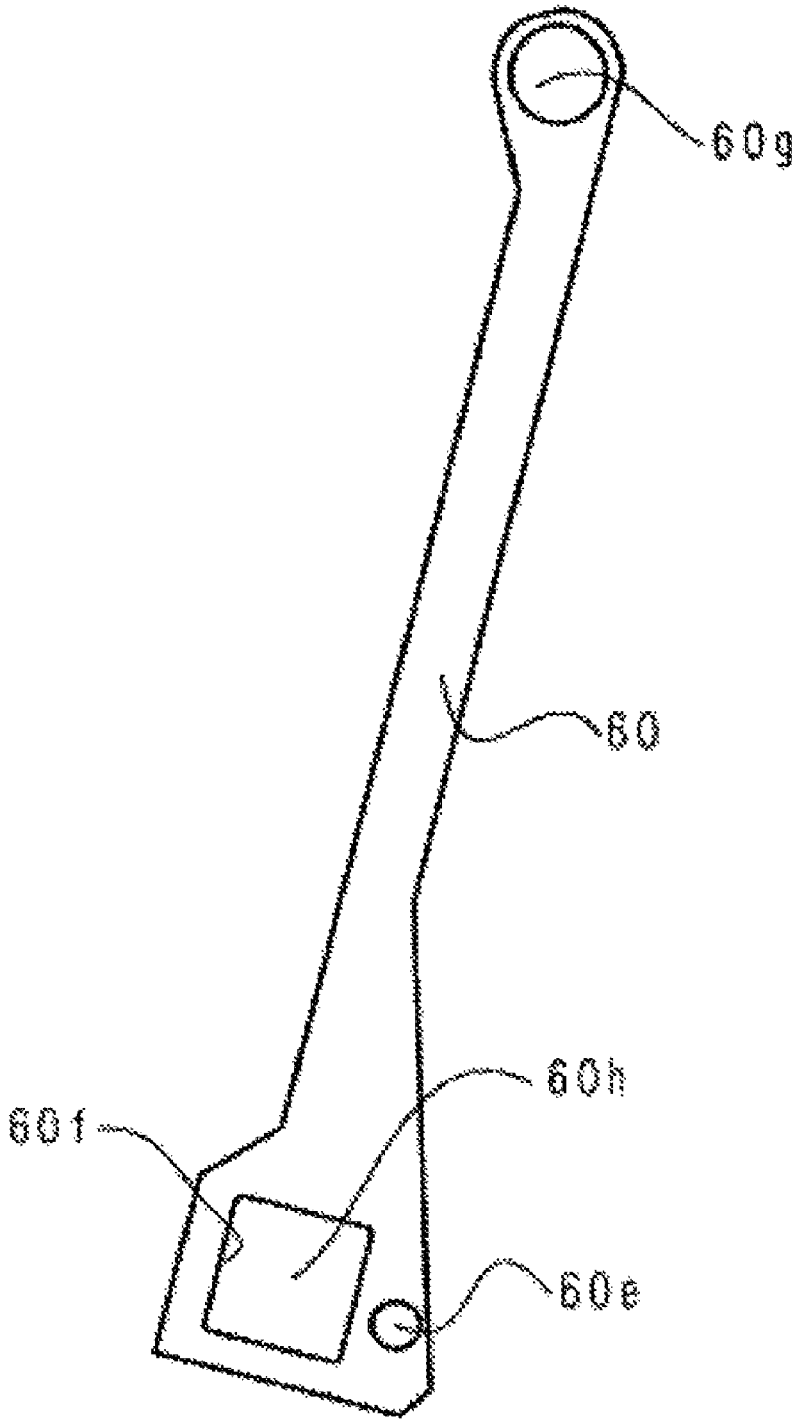
FIG. 14 is a schematic view showing a characterizing portion of a process cartridge in Second Embodiment.

The charging device space keeping member 60 is, as shown in FIG. 14, provided with a hole 60*g* at one end thereof and a holding projection 60*e* for holding the charging roller 2 in a separated state at the other end. The charging device space keeping member 60 is supported by the charging roller 2 rotatably provided by engaging the shaft 2*j* of the charging roller 2 into the hole 60j as shown in FIG. 13. Further, the charging device space keeping member 60 holds the charging roller 2 in the separated state by engaging (hooking) the holding projection 60*e* on a holding claw 27*e* provided to the cleaning device frame 27. In this case, the charging device space keeping member 60 keeps the separated state of the charging roller 2 against a force of a charging roller pressing member 46 which presses the charging roller 2 against the photosensitive drum 1. Incidentally, the holding claw 27*e* may also be provided to the developing device frame 31.

Figure 15:
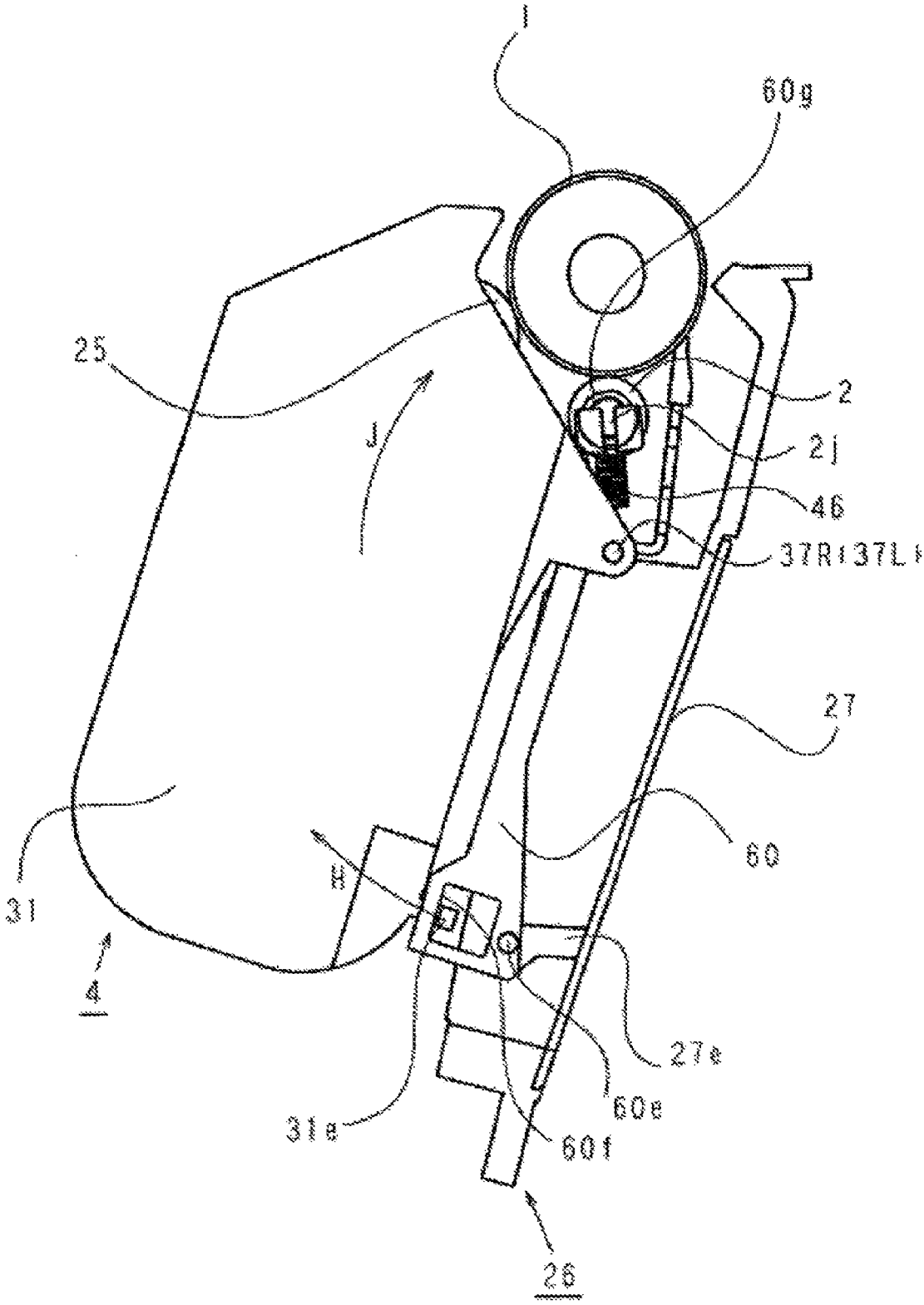
FIG. 15 is a schematic view showing a state of release of space keeping by a charging device space keeping member in the process cartridge.

During the use of the cartridge 7, as show in FIG. 15, the developing device frame 31 is swung in the direction indicated by an arrow J in order to contact the developing roller 25 to the photosensitive drum 1. In that case, a releasing claw 31*e* provided to the developing device frame 31 is inserted into a hole 60*h* provided to the other end of the space keeping member 60, so that the releasing claw 31*e* contacts a force-receiving portion 60*f* when the developing device frame 31 is swung. Then, the force-receiving portion 60*f* receives a tension toward the direction indicated by an arrow H to disengage the holding claw of the space keeping member 60 from the holding claw 27*e* to contact the charging roller 2 to the photosensitive drum 1.

Incidentally, the space keeping constitution of the developing device frame 31 is similar to that in First Embodiment described with reference to FIGS. 1 and 7. First, during the non-use of the cartridge 7 such as during the shipment, the developing device frame 31 is kept in the separated state by the space keeping member 60. Further, the protective cover 70 is mounted so that the projections 70R and 70L are inserted between the photosensitive drum 1 and the abutment portions 31R and 31L of the developing device frame 31. The constitution in which the projections 70R and 70L are inserted between the photosensitive drum 1 and the abutment portions 31R and 31L of the developing device frame 31 is also similar to that in First Embodiment.

By the above-described constitutions, it is possible to achieve the same effect as that of First Embodiment.

Figure 16:
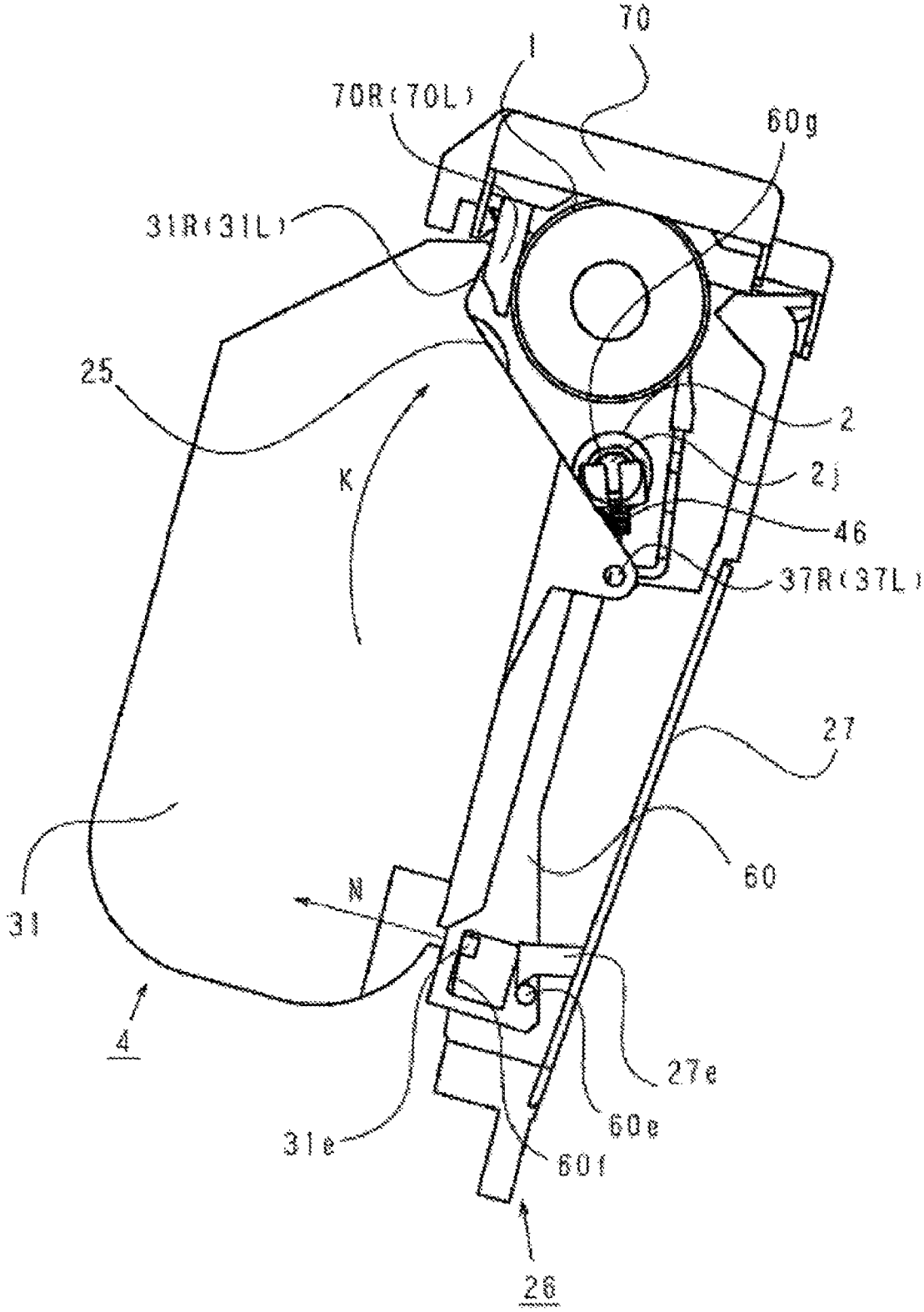
FIG. 16 is a schematic view showing a state of the process cartridge during transportation.

Further, as shown in FIG. 16, when the developing roller 25 is moved toward the direction indicated by an arrow K by the impact during the transportation, the abutment portions 31R and 31L of the developing device frame 31 abut against the projections 70R and the 70L of the protective cover. Therefore, the movement of the developing roller 25 toward the photosensitive drum 1 is regulated, so that the contact therebetween is prevented. In this case, similarly, the releasing claw 31*e* of the developing device frame 31 is also regulated in amount of movement toward the direction indicated by an arrow N. Therefore, the release of the space keeping of the charging roller 2 is prevented by the regulation of the releasing claw 31*e* before the holding projection 60*e* of the space keeping member 60 is disconnected from the holding claw 31*e* of the cleaning device frame 27. Thus, even when the developing device frame 31 is moved by the impact during the transportation, the separated state of the charging roller 2 can be maintained. Thus, it is possible to keep the separated state of the charging roller 2 with reliability, so that a stable image can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 138247/2008 filed May 27, 2008, which is hereby incorporated by reference.

What is claimed is:

1. A process cartridge comprising:

a first unit including an electrophotographic photosensitive member;

a second unit including a developing roller contactable to the electrophotographic photosensitive member for developing an electrostatic latent image formed on said electrophotographic photosensitive member, said second unit being swingable about a swing shaft with respect to said first unit;

an urging member for exerting an urging force between said first unit and said second unit so as to contact the developing roller to the electrophotographic photosensitive member;

a developing device space keeping member for keeping a space between the developing roller and said electrophotographic photosensitive member; and a protective cover, detachably mountable to at least one of said first unit and said second unit, including a protective portion for protecting said electrophotographic photosensitive member and including a projection which is insertable into a gap between said first unit and said second unit so as to prevent contact between said electrophotographic photosensitive member and said developing roller and which is non-contactable to said first unit and said second unit in a developing device space keeping state by said developing device space keeping member.

2. A cartridge according to claim 1, wherein the projection is located closer to the gap than said developing device space keeping member in a state in which said protective cover is mounted to at least one of said first unit and said second unit.

3. A cartridge according to claim 1, wherein with respect to the swing shaft, the projection is located on a gap side and said developing device space keeping member is located on a side opposite from the gap side.

4. A cartridge according to claim 2, wherein at least a pair of the projection is located between the electrophotographic photosensitive member and the developing roller in the state in which said protective cover is mounted to at least one of said first unit and said second unit.

5. A cartridge according to claim 1, further comprising a charging roller, and a charging device space keeping member which is engageable to a holding portion provided to one of said first unit and said second unit so as to keep a charging device separation state in which said charging roller is separated from said electrophotographic photosensitive member and which acts so as to release the charging device separation state when the other one of said first unit and second unit is swung.

* * * * *